US006587021B1

(12) United States Patent
Streeter

(10) Patent No.: US 6,587,021 B1
(45) Date of Patent: Jul. 1, 2003

(54) MICRO-RELAY CONTACT STRUCTURE FOR RF APPLICATIONS

(75) Inventor: Richard D. Streeter, Fort Wayne, IN (US)

(73) Assignee: Raytheon Company, Lexington, MA (US)

( * ) Notice: Subject to any disclaimer, the term of this patent is extended or adjusted under 35 U.S.C. 154(b) by 279 days.

(21) Appl. No.: 09/710,989

(22) Filed: Nov. 9, 2000

(51) Int. Cl.[7] ..... H01P 1/10

(52) U.S. Cl. ..... 333/262; 333/105; 200/181; 335/78

(58) Field of Search ..... 333/262, 101, 333/105; 200/181; 335/78, 106, 159, 160, 186

(56) References Cited

U.S. PATENT DOCUMENTS

| | | | | |
|---|---|---|---|---|
| 5,479,042 A | * 12/1995 | James et al. | 257/415 |
| 5,872,496 A | 2/1999 | Asada et al. | 335/78 |
| 5,959,338 A | 9/1999 | Youngner et al. | 257/419 |
| 6,025,767 A | 2/2000 | Kellam et al. | 335/128 |
| 6,078,233 A | 6/2000 | Misumi et al. | 335/128 |
| 6,426,687 B1 | * 7/2002 | Osborn | 333/262 |

FOREIGN PATENT DOCUMENTS

| | | | |
|---|---|---|---|
| JP | 06338244 | 12/1994 | H01H/61/02 |
| JP | 06338245 | 12/1994 | H01H/61/02 |
| WO | WO 97/39468 | 10/1996 | H01H/51/22 |
| WO | WO 99/50863 | 3/1999 | |

OTHER PUBLICATIONS

Microstrip, coplanar, or strip transmission lines (Reference Data for Engineers, Ch 29).

"GaAs–compatible surface–micromachined RF MEMS switches", D. Hyman, et al., Electronic Letters, Feb. 4, 1999, V35, No.3.

"Micromechanical Electrostatic K–Band Switches" Pacheco, S; Nguyen, C.T–C.; Katehi, L.P.B. IEEE MTT–S Symposium Digest V3, 1998, pp1569–1572, IEEE 98CH36192.

"Surface micromachined miniature switch for telecommunications applications with signal frequencies from DC up to 4 GHz" Yao, J.J.; Chang, M.F. International Conference on Solid–State Sensors and Actuators, and Eurosensors IX, Proceedings V2 1995, pp384–387.

"Performance of low–loss RF MEMS Capacitive Switches", Goldsmith, C.L.; Zhimin, Yao; Eshelman, S.; Dennison, D., IEEE Microwave and Guided Wave Letters, vol. 8, No. 8, Aug. 1998, pp 269–271 ISSN–1051–8207.

"Scream MicroElectroMechanical Systems", Noel C. MacDonald, Microelectronic Engineering 32 (1996), p47–73, Elsevier Science B.V., SSDI:0167–9317(96)–00007–X.

Introduction to Microelectromechanical (MEM) Microwave Systems, Hector J. De Los Santos, Artech House, 1999, ISBN 0–89006–282–X.

* cited by examiner

*Primary Examiner*—Robert Pascal
*Assistant Examiner*—Dean Takaoka
(74) *Attorney, Agent, or Firm*—Daly, Crowley & Mofford, LLP

(57) ABSTRACT

A MEM relay device includes a flexible multi-point contact system with a self-aligning structure. The inventive relay includes a first signal contact electrically connected to a first set of flexible electrically conductive signal teeth and a second signal contact electrically connected to a second set of flexible electrically conductive signal teeth. An actuator, selectively moves a shorting contact between an open and closed position. In the closed position, two sets of flexible electrically conductive shorting teeth mesh with a first set of flexible electrically conductive signal teeth and the second set of flexible electrically conductive signal teeth creating a conductive path between the two signal contacts. The contact structure facilitates fabrication using a deep reactive ion etch (DRIE) process and brings signal and actuator contacts to an edge of each die.

39 Claims, 9 Drawing Sheets

MICRO-RELAY CONTACT STRUCTURE FOR RF APPLICATIONS

FIELD OF THE INVENTION

This invention relates generally to electrical and electronic circuits and components and more particularly to micro-electromechanical (MEM) relays for radio frequency (RF) applications.

BACKGROUND OF THE INVENTION

A MEM relay is an electrical micro-relay operated by an electrostatic charge, magnetic, piezoelectric or other actuation mechanism and manufactured using micro-electromechanical fabrication techniques. A MEM relay uses an electrically activated structure to mechanically close a set of electrical contacts. A MEM relay can be used to control RF signal flow in a wide range of electronic applications including telecommunications applications.

Current efforts in designing RF micro-relays or RF switches using MEM fabrication techniques concentrate on the actuator design and on the closed circuit RF characteristics of the RF signal path. The open circuit isolation of the signal path is partially determined by the physical separation of the contact structure, and is an uncontrolled parameter in most MEM microrelay structures. Additionally in some applications, conventional MEM relay designs do not provide sufficient isolation between the actuation mechanism and the signal contact structure of the MEM relay operating at radio frequencies. A problem occurs when large RF voltages on the signal contact structure activate or self-bias the electrostatic actuator or other high impedance actuator and causing the micro-relay to become uncontrollable. Also, large control signals on the actuator structure can couple onto the signal contact structure and as a result, disrupt or interfere with the flow of very weak signal currents.

The electrical isolation between the signal path and the actuation control path in a MEM relay distinguishes the MEM relay from a MEM switch. The term "RF Micro-relay" is normally used to designate a 4 terminal device with two terminals used for an actuation function and two terminals used to control the flow of the RF signal in an external circuit. The term "RF MEM switch" is so used interchangeably with RF micro-relay. However, the RF MEM switch function may also include a condition where the actuation process and the signal control process have one or more common elements, such as a common ground. The "RF MEM switch" could then be a two terminal device or a three terminal device as well as a four terminal device. The term "micro-relay" will be applied to the 4 terminal device, and the contact structure within the micro-relay used to control the RF signal flow in an external circuit will be referred to as contacts.

Conventional MEM fabrication technology tends to limit the type of contact metals and shapes that can be supported. The contacts fabricated in the conventional manner tend to have lifetimes in the millions of cycles or less. One of the problems encountered is that microscale contacts on MEM devices tend to have very small regions of contact surface (for example 5 micrometers by 5 micrometers). The portion of the total contact surface that is able to carry electrical current is limited by the microscopic surface roughness and the difficulty in achieving planar alignment of the two surfaces making mechanical and electrical contact. Furthermore, most conventional MEM switches or relays have only one contact set. The contacts that would seem to have hundreds or thousands of square micrometers of contact surface available are actually multiple small point contacts with a much smaller equivalent contact surface area. The high current densities in these small effective contact regions create microwelds and surface melting, resulting in impaired or failed contacts. Such metallic contacts tend to have relatively short operational lifetimes, usually in the millions of cycles.

A MEM contact structure can be fabricated using either surface micromachilling or bulk micromachining techniques including deep reactive ion etch (DRIE). Surface micromachining builds a MEM structure on the surface of a substrate by the proper combinations of depositing and etching MEM fabrication materials. The deposition and etching is usually based on a pattern needed to selectively obtain the desired end mechanical structure. State of the art surface micromachining requires a wet etching process and uses liquids in various stages of the fabrication and the releasing process. In the MEM manufacturing process, moving structures are created by depositing the desired material in a mold composed of sacrificial MEM fabrication material which defines the shape of the end movable structure. The sacrificial material is etched away as the final step in manufacturing, and this releases the movable portion of the MEM structure. Bulk micromachining builds the MEM structure within the substrate material but exposed at the substrate surface. The etching process can cut away portions of the substrate surface and body to form the MEM structure. The etching process can also undercut the structure. Undercutting the structure allows lateral motion in the full 2-dimensional surface plane of the substrate. The actual motion available depends on the design of the movable parts. Bulk micromachining also uses deposition and etching processes. Some methods of bulk micromachining also use wet processes. DRIE is a fully dry process of bulk micromachining. The use of liquids has been found to result in difficult cleaning requirements, contamination of the MEM device, and a problem of MEM operation known as "stiction", a combination of stickiness and friction. Dry MEM fabrication processes are believed to be free of the stiction problem. DRIE creates high-aspect ratio, 3-dimensional structures in silicon, with thicknesses ranging from microns to hundreds of microns. DRIE allows micro-machined structures to be combined readily with CMOS electronics and devices constructed using traditional bulk and surface micro-machining techniques.

SUMMARY OF THE INVENTION

In view of the above problems and limitations of existing MEM relays and in accordance with the present invention, it would, therefore, be desirable to have a MEM relay having one or more of the following characteristics: a multi-point contact system using a self-aligning structure, improved and controllable open circuit isolation characteristics, electrostatic shielding between the actuator system and the RF signal switching system and electrostatic shielding between the relay signal contacts. It is also desirable to have a MEM relay which can be fabricated using a dry fabrication process such as DRIE or other dry bulk micro-machining techniques.

In accordance with an aspect of the present invention, the MEM relay includes a housing, a first signal contact in the housing, a second signal contact in the housing, a grounded electrostatic actuator shield in the housing forming a signal contact region and an actuator region and an aperture formed in the housing to connect the signal contact region and the actuator region. The MEM relay also includes an actuator, with an open and closed position connected to an actuator insulator that passes through the aperture and is connected to a movable shorting contact. The shorting contact can electrically connect the first signal contact to the second signal contact thereby completing the relay circuit. With such an arrangement the MEM relay has an electrostatic (Faraday) shield between the actuator system and the RF signal switching system that improves isolation between the signal contact structures and the actuator mechanism. The shield contributes to the open circuit isolation of the signal path. The electrostatic shield also prevents large RF voltages on the signal contact structure from activating or self-biasing an electrostatic actuator or other high impedance actuator and causing the micro-relay to become uncontrollable. The electrostatic shield will also prevent large control signals on the actuator structure from coupling onto the signal contact structure and disrupting or interfering with the flow of very weak signal currents. The electrostatic shield in alternate configurations can act as a signal ground to form a capacitive attenuator or capacitor-resistor attenuator between the RF relay input and RF relay output terminals when the relay is in the open position. The electrostatic shield provides an isolation level that is relatively independent of frequency in the capacitive attenuator embodiment. The electrostatic shield partially determines the RF impedance when the relay is closed.

In accordance with a further aspect of the present invention, a MEM relay includes a first signal contact electrically connected to a first set of electrically conductive signal teeth and a second signal contact electrically connected to a second set of electrically conductive signal teeth. An actuator selectively moves a shorting contact, which has two sets of electrically conductive shorting teeth, between an open and a closed position. In the closed position, the two sets of shorting teeth mesh with the first set of electrically conductive signal teeth and the second set of electrically conductive signal teeth creating a conductive path between the two signal contacts. Such an arrangement provides an RF MEM relay having a flexible multi-point contact system with a self-aligning structure.

In accordance with a still further aspect of the present invention, the MEM relay has an electrostatic (Faraday) shield between the two signal contacts of the relay. The shield helps increase the isolation between the signal contacts when the relay is open, and contributes to the value of the RF impedance in the signal path when the relay is closed.

In accordance with another aspect of the present invention, the MEM relay has a structure which can be machined by a deep reactive ion etch (DRIE) bulk manufacturing process or other bulk micromachining techniques.

These and other objects, aspects, features and advantages of the invention will become more apparent from the following drawings, detailed description and claims.

BRIEF DESCRIPTION OF THE DRAWINGS

The foregoing features of this invention, as well as the invention itself may be more fully understood from the following description of the drawings in which.

DETAILED DESCRIPTION OF THE INVENTION

Figure 1A:
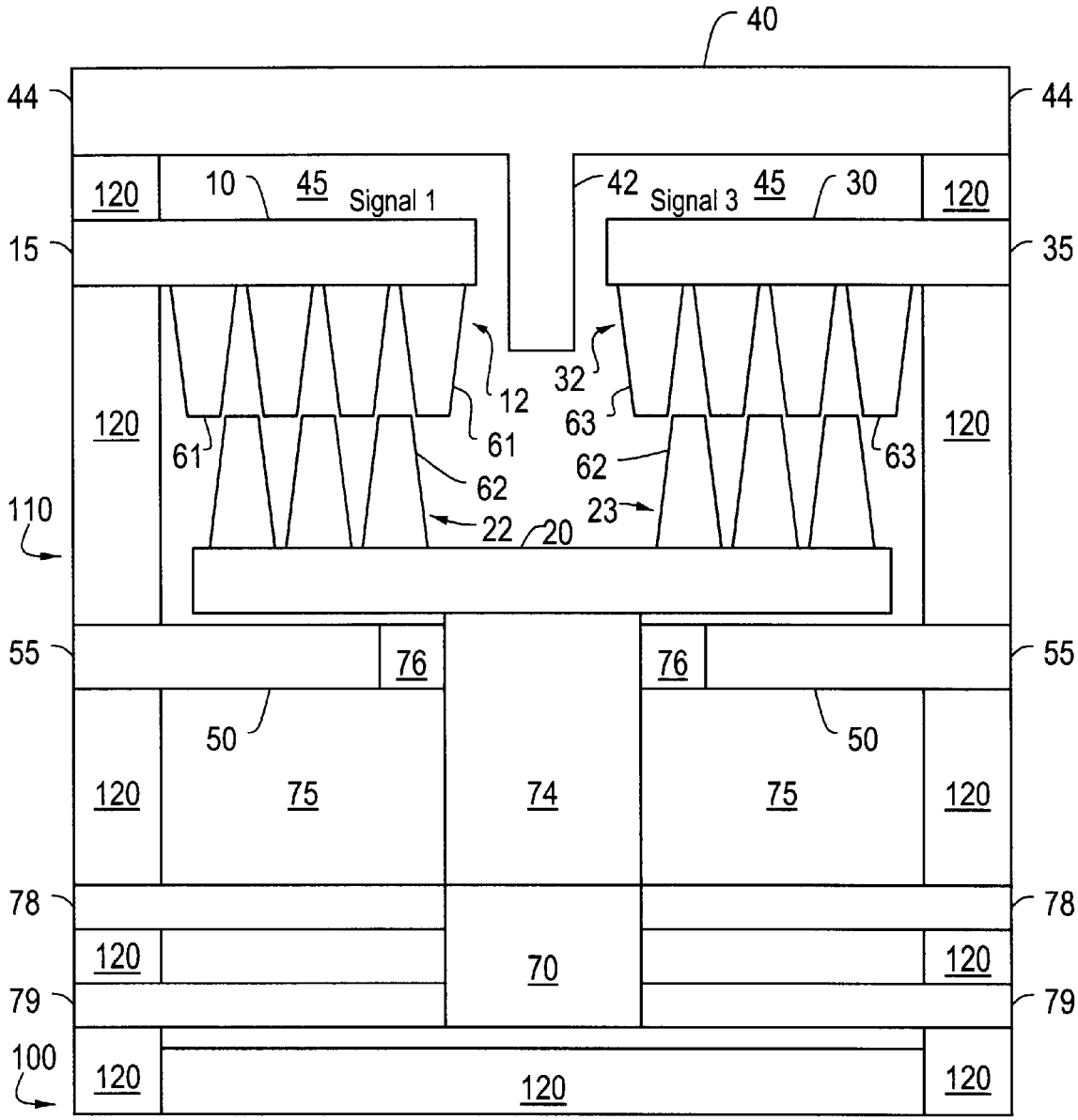
FIG. 1A is a cross sectional top view of the surface of a micro-electromechanical (MEM) substrate illustrating the integrated actuation assembly and contact assembly forming a MEM relay in an open position according to the present invention.

Referring now to FIG. 1A, one embodiment of the physical structure of a signal contact region 45 and an actuator region 75 of an inventive relay 100 is shown with the relay contacts in an open circuit position. The cross-sectional view is a horizontal slice though the MEM manufacturing substrate, and shows only the components of the relay 100. FIG. 1A illustrates the surface of the MEM fabrication structures prior to any protective encapsulation. The relay 100 structure is fabricated within a housing 110, which is typically formed by a substrate material 105 as will be described further in connection with FIG. 1D. An external signal connection 15, and an external signal connection 35 of relay 100 are formed by a signal 1 contact 10 and a signal 3 contact 30 which are fabricated in housing 110 and supported by insulator sections 120 or alternatively other support structures consistent with the specific MEM fabrication process used to manufacture the relay 100. The relay 100 includes an actuator 70 which is connected to an actuator insulator 74 and which moves a movable shorting contact 20 between an open and closed position. The actuator insulator 74 is connected to the shorting contact 20 and isolates the signal path from the actuation structure. The actuator insulator 74 also provides mechanical support for the shorting contact 20 structure.

The shorting contact 20 is mechanically connected to the actuator 70, and is electrically insulated from the actuator 70 by an intervening actuator insulator 74, as shown in FIG. 1A. The actuator insulator 74 may be of any size as dictated by the MEM fabrication process and the electrical isolation that can be achieved between shorting contact 20 and actuator 70. The actuator insulator 74 isolates the actuator 70 from the structure of shorting contact 20, and actuator insulator 74 also helps in reducing the coupling between the actuator region 75 and the signal contact region 45. The actuator section is shown with a vapor gap 76 created by the clearance spacing for the actuation system (actuator 70 and actuator insulator 74) so actuator insulator 74 will not contact a grounded electrostatic actuator shield 50 or any of the housing structure for the signal contact region 45. The shorting contact 20 is mechanically connected to the actuator insulator 74. As described below in more detail in conjunction with FIGS. 2A–2D, the shorting contact 20 contributes to the open circuit RF signal attenuation in varying amounts by mechanically touching the grounded electrostatic actuator shield 50, by mechanically touching but remaining insulated from the grounded electrostatic actuator shield 50, by not touching the grounded electrostatic actuator shield 50 because of a physical gap or electrically contacting the grounded electrostatic actuator shield 50 when the relay 100 is open. It should be appreciated that there are other configurations of the shorting contact 20 and the grounded electrostatic actuator shield 50 interface.

The larger the vapor gap 76 becomes, the smaller the area available for the mechanical contact between the grounded electrostatic actuator shield 50 and the shorting contact 20 when the relay 100 is open. Thus, the vapor gap 76 should be as small as possible consistent with the MEM fabrication process. The vapor or insulating gas can move with relative freedom around the full actuator insulator 74 and signal contact structure, as that will reduce gas damping and the associated switching speed reduction caused by a significantly constrained gas flow.

Signal 1 electrically conductive signal teeth 12 (hereinafter referred to as signal teeth 12) is a structure disposed on signal 1 contact 10 having teeth 61 that can mesh with a first set of electrically conductive shorting teeth 22 (hereinafter referred to as shorting teeth 22) which is disposed on shorting contact 20. Here four signal 1 teeth 61 are shown to mesh with three shorting teeth 62, however more or fewer teeth could be used to provide an electrical contact. Signal 3 electrically conductive signal teeth 32 (hereinafter referred to as signal teeth 32) disposed on signal 3 contact 30, are also shown having four teeth 63 which can mesh with a second set of three electrically conductive shorting teeth 23 (hereinafter referred to as shorting teeth 23).

Figure 1B:
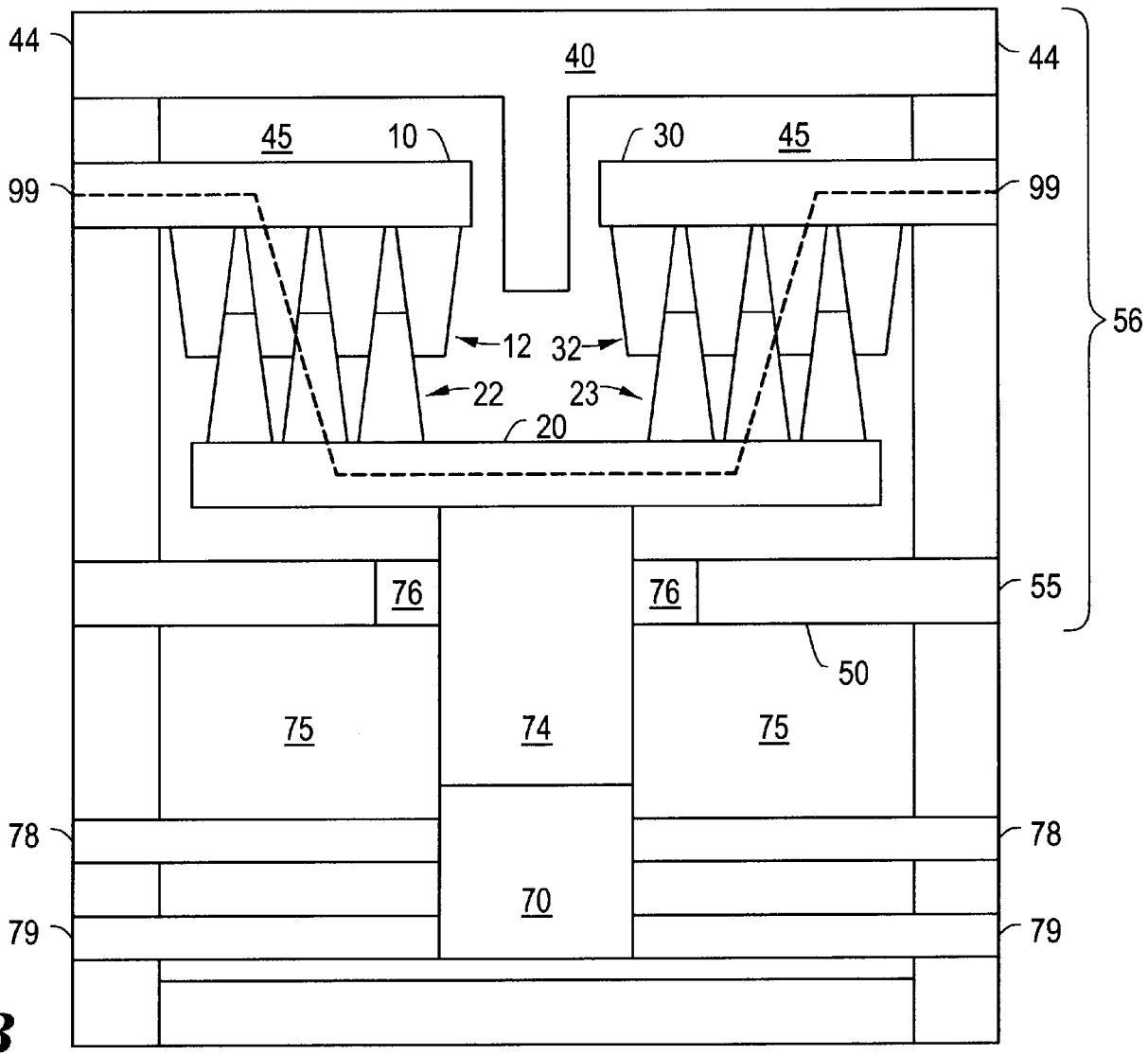
FIG. 1B is a cross sectional view of the structures of the MEM relay of FIG. 1A in a closed position.

Referring now to FIG. 1B, when the relay 100 is in a closed position, a signal circuit 99 is provided by the electrical connection from external signal connection 15 of signal contact 10 to signal teeth 12 to shorting teeth 22 to shorting contact 20 to shorting teeth 23 to signal teeth 32, and finally to signal 3 contact 30 having an external signal connection 35. Ground surfaces 40, 42, and 50 are similar to grounds in a strip line signal structure or a coaxial structure. These ground surfaces are externally connected through external ground plane connections 44 and external grounded electrostatic actuator shield connections 55. FIG. 1B shows the relay 100 in a closed configuration. When the actuator 70 is energized through actuator connections 78, 79, the relay 100 signal contacts are closed. The motion of the actuator 70 moves the shorting contact 20 forcing first set of shorting teeth 22 and second set of shorting teeth 23 into meshed contact with signal teeth 12 and signal teeth 32. This closes the connection between shorting contact 20 and signal contacts 10 and 30 forming a complete conductive signal path from the externally accessible portions of signal 1 contact 10 external signal connection 15 and signal 3 contact 30 external signal connection 35 of the relay 100.

Referring again to FIG. 1A, the electrically conductive surfaces 61, 62, and 63 are preferably solid structures, and are referred to "teeth". However, the reference to "teeth" is not meant to limit the shape or construction of the conductive surfaces. As shown in FIG. 1A, there must be at least one shorting tooth 62 for each set of shorting teeth 22, at least one signal 1 tooth 61 for the signal teeth 12 structure, at least one shorting tooth 62 for each set of shorting teeth 23, and one signal 3 tooth 63 for the signal teeth 32 structure. More than one contact per contact structure may be used for improved reliability, greater structural integrity, the ability to handle a greater total current density in the relay 100, contact heat transfer, and lower overall contact resistance. Signal teeth 12, shorting teeth 22, shorting teeth 23, and signal teeth 32 promote a multiple contact surface capability, as will be described further in connection with FIGS. 5A and 5B. The use of multiple contact surfaces (multiple sets of teeth) makes the relay 100 capable of handling more current flow than is possible with a single contact surface.

The actuator 70 is located in an actuator region 75 and is shielded from the signal contact region 45 by a grounded electrostatic actuator shield 50 in the relay 100 structure in order to reduce interference. External grounded electrostatic actuator shield connections 55 are used to obtain the ground reference for the grounded electrostatic actuator shield 50. When the relay 100 is open, the shorting contact 20 of the circuit (the movable section of the relay 100 contact structure) will be in very close proximity to the grounded electrostatic actuator shield 50 structure. Alternatively, the shorting contact 20 of the circuit can touch the grounded electrostatic actuator shield 50 structure when the relay 100 is open.

The ground plane 40, supported by insulators 120 and other structures appropriate to the MEM fabrication process, provides additional shielding for relay 100 and a controlled impedance path structure for the RF signals present on signal path 99. Another shield structure, grounded electrostatic signal shield 42 is connected to ground plane 40 and other structures appropriate to the MEM fabrication process, and reduces coupling and increases electrical isolation by shielding signal 1 signal teeth 12 and signal 1 contact 10 from signal 3 signal teeth 32 and signal 3 contact 30. External ground plane connections 44 are used to obtain the ground reference for the ground plane 40. Ground plane 40, grounded electrostatic signal shield 42 and grounded electrostatic actuator shield 50 may also be interconnected internally (not shown) as part of the relay 100. The relay housing 110 contains several insulator sections 120 defining the signal contact region 45. There are several insulator sections 120 shown for the actuator region 75. The details of the actuator 70 structure are known by one skilled in the art and are not shown. The grounded electrostatic actuator shield 50 may be connected externally to the relay 100 structure and to ground plane 40 which is connected to grounded electrostatic signal shield 42. Grounded electrostatic actuator shield 50 is part of the signal isolation capacitive attenuation network when the relay 100 is open.

Referring again to FIG. 1B, grounded electrostatic actuator shield 50 can form part of a strip transmission line 56 structure which also includes ground plane 40 and grounded electrostatic signal shield 42, and the signal circuit 99 when the relay 100 is closed. Grounded electrostatic actuator shield 50 helps determine the RF impedance characteristics of the signal circuit 99. Grounded electrostatic signal shield 42 provides an electrostatic shield between signal 1 contact 10 and signal 3 contact 30 signal paths when the relay 100 is in the open position. Grounded electrostatic signal shield 42 is also part of the strip transmission line 56 that determines the RF impedance of the signal circuit 99 when the relay 100 is closed.

The insulator sections 120 along the edge of the housing 110 are present for mechanical support of the ground plane 40, grounded electrostatic actuator shield 50, signal 1 contact 10 and signal 3 contact 30. The insulator sections 120 along the perimeter of the relay 100 form a fully contained structure. The grounded electrostatic actuator shield 50, the ground plane 40 and the insulator sections 120 form an enclosed signal contact region 45, preventing external contaminants from entering the signal contact region 45. When the relay 100 is closed, the insulator sections 120 are part of the strip transmission line 56 structure that helps determine the RF impedance characteristics of the signal circuit 99. The physical configuration of the insulators depends on the details of the layout and fabrication processes. As is known in the art, the desired shape and size of the housing 110, insulator sections 120 and other components of the MEM relay 100, can be varied with corresponding change in the electrical characteristics. Implementation of the MEM relay 100 structure may be a function of the MEM fabrication process, with variations in the process technology dictating the construction of the various structures within the general descriptions provided.here. It is to be appreciated that there are several types of actuators and that the relay 100 could be operated as normally open or normally closed, and the operation of the actuator 70 (energized to close the relay 100 contacts) could be reversed. As is also known by one skilled in the art, magnetic, electrostatic, piezoelectric, thermal, pneumatic, hydraulic, and chemical actuators may be used to move shorting contact 20. The actuator control contacts 78 and 79 are shown electrically connecting the actuator 70 to the edge of the housing 110. The actuator control contacts 78 and 79 provide an electrical contact to control the motion of the actuator 70 by external electrical means. Actuator control may be provided by other means also, and may result in increased contact forces for better contact performance. The actuator 70 must provide the application of sufficient force to close and open the relay 100 signal contacts (signal 1 contact 10 and signal 3 contact 30) upon command, and to perform that function in a timely and power efficient manner.

Figure 1C:
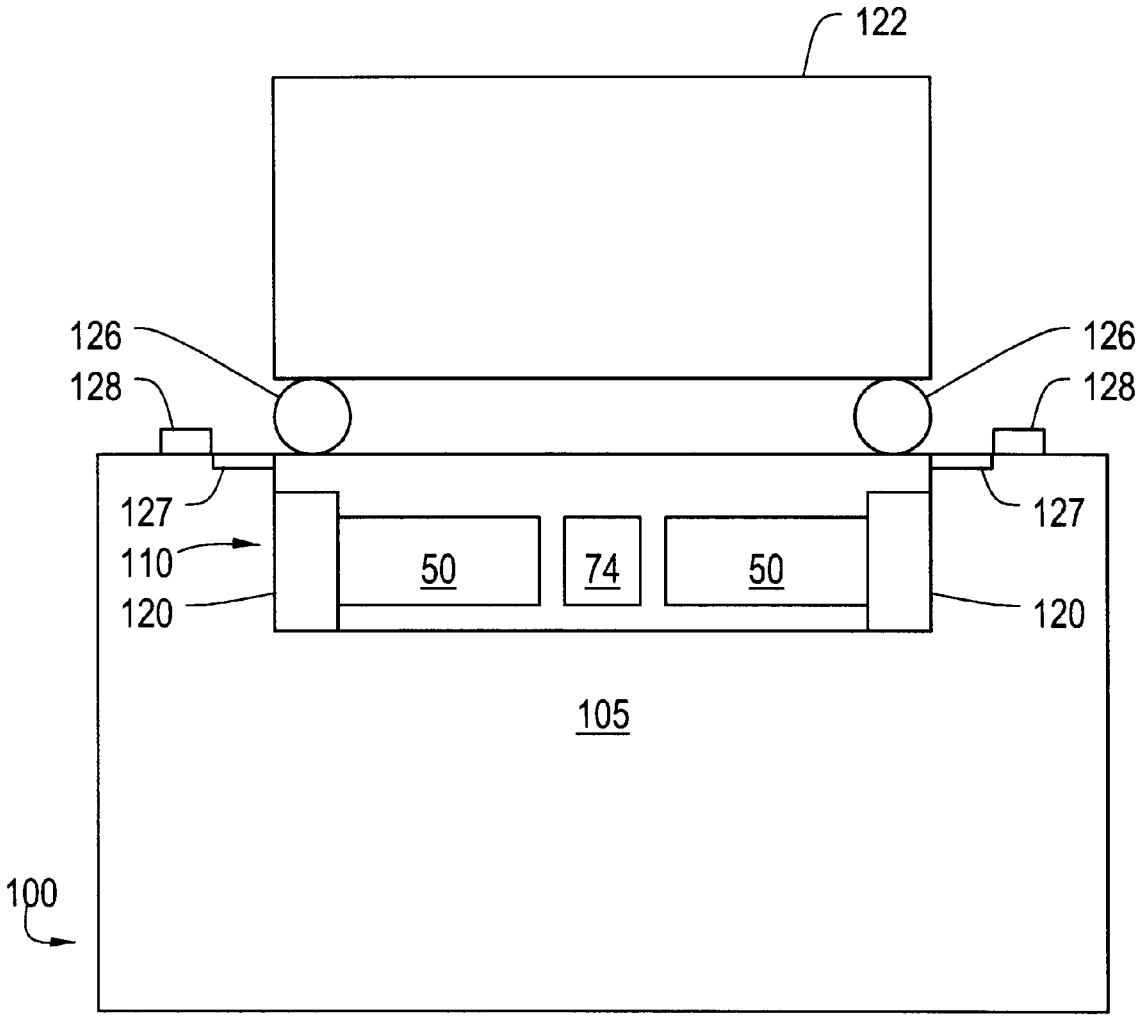
FIG. 1C is a cross sectional side view (through the actuator insulator) of the MEM relay of FIG. 1A.

Referring now to FIG. 1C, relay 100 can include a top cover 122 which forms a fully sealed RF relay 100. In the DRIE process, the bottom is usually provided by a substrate 105 into which the structure is etched. The perimeter insulators 120 and housing 110 are also usually provided by the substrate material 105. The top cover 122 is usually a separate assembly which is bonded to the substrate 105 using a sealing frit material 126. The top cover 122 must not obscure the external contacts external signal connection 15, external signal connection 35, actuator control contacts 78 and 79, external ground plane connections 44, and external grounded electrostatic actuator shield connections 55, which are connected to bonding pads 128 using conductors 127. The conductors 127 are preferably a metalization layer, or any means known in the art for making connections to bonding pads. Alternatively, running the metal within the sealed structure to the edges of the dicing area (the sawing streets of the wafer) eliminates the need for bonding pads 128 and conductors 127 on the surface of the substrate. If the top cover 122 is used as any part of an electrical signal path (grounds or signal circuit 99), the bonding material for the top cover 122 must be conductive only to the desired internal points. External ground plane connections 44 can be connected with the external grounded electrostatic actuator shield connections 55 by a conductive path across the sealing frit material 126 and the top cover 122, but the other connections including external signal connection 15, external signal connection 35, and actuator control contacts 78 and 79 must remain isolated.

Figure 1D:
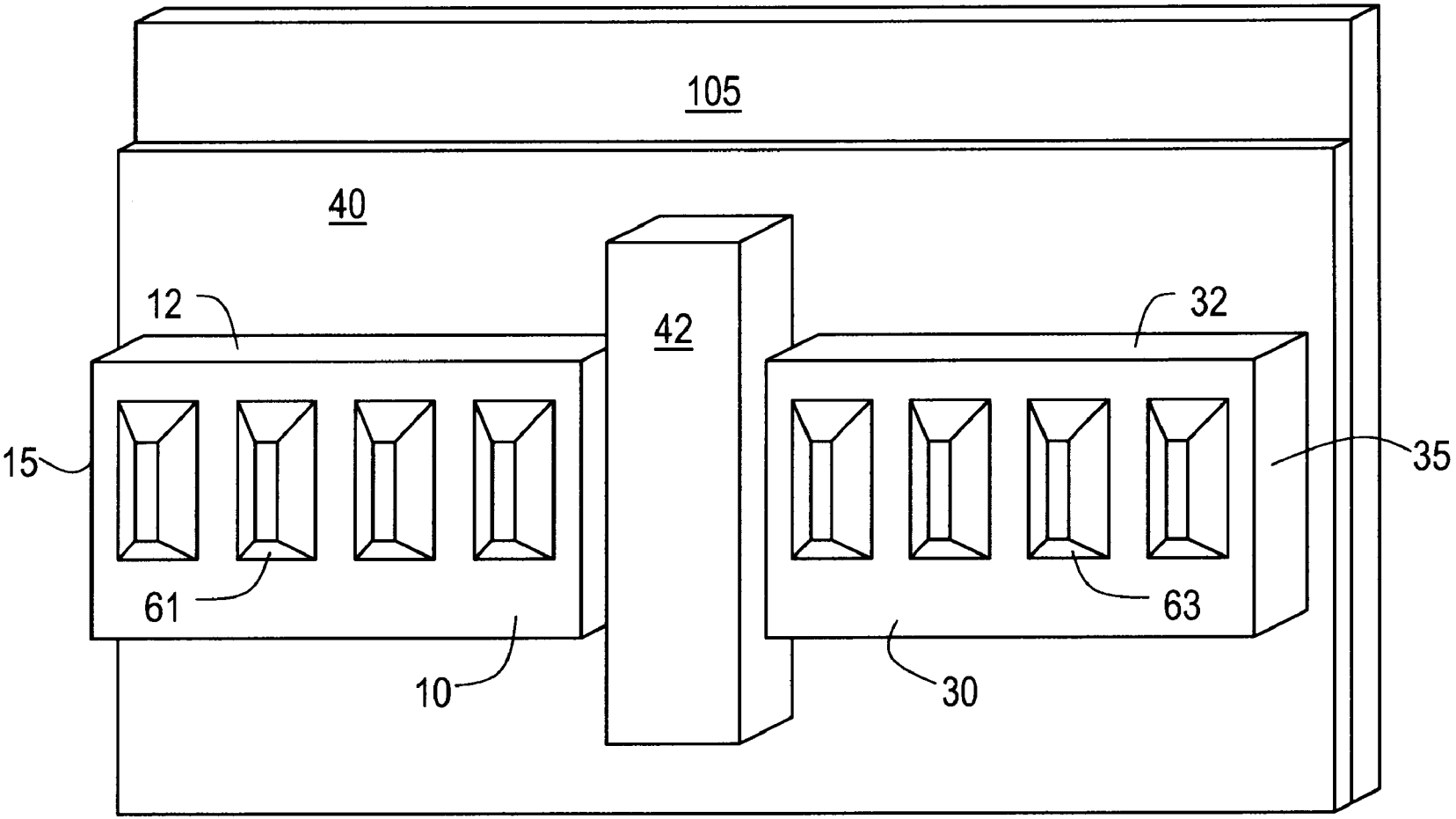
FIG. 1D is a perspective view of the two signal contact structures of FIG. 1A facing the shorting contacts.

Referring now to FIG. 1D, signal 1 teeth and signal 2 teeth can include, in one embodiment, trapezoidal shaped teeth 61 arranged to mesh with similarly shaped shorting teeth 22 and 23 respectively. It should be appreciated that the teeth can have a variety of shapes subject to the limitations of the micro-machining process used for fabrication. The grounded electrostatic signal shield 42 is located between signal 1 contact 10 and signal 3 contact 30 and is supported by ground plane 40 which is formed from the substrate 105. Although FIG. 1D shows teeth with sloped sides for clarity, the DRIE process currently is limited to the fabrication of substantially vertical and horizontal surfaces.

Figure 2A:
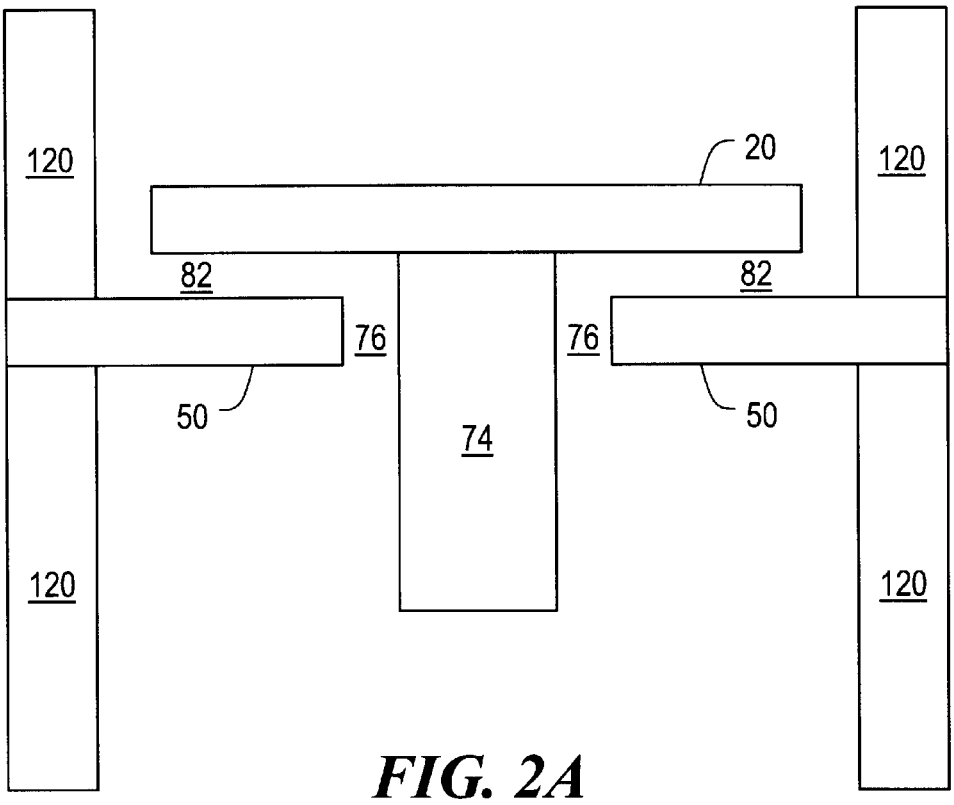
FIG. 2A is a cross sectional view of a gap between the shorting contact and the grounded electrostatic actuator shield relay in an open position according to the present invention.

FIGS. 2A, 2B, 2C, and 2D show some of the fabrication details which can affect the electrical characteristics of relay 100. Referring now to FIG. 2A, a gap 82 can exist between shorting contact 20 and grounded electrostatic actuator shield 50 when the relay 100 is open. In this configuration, the shorting contact 20 and grounded electrostatic actuator shield 50 are insulated from each other by gap 82 in the open position of relay 100. Shorting contact 20 must have a conductive path between the shorting teeth 22 shorting teeth 23. This can be accomplished by fabricating the entire shorting contact 20 with metal, placing a shorting contact metal layer 24 (not shown) completely over a shorting contact constructed from insulating material or partially over the surface where the conductive path is required. Solid metal or complete metalization on the entire shorting contact 20 is preferred if the maximum open circuit isolation in the signal path is desired. In addition to the shorting contact 20, the shorting teeth 22 and 23 may be solid metal, hollow metal, or a MEM fabrication material (solid or hollow) coated with the shorting contact metal layer 24 (not shown). Preferably shorting contact 20 is a solid metal structure.

Figure 2B:
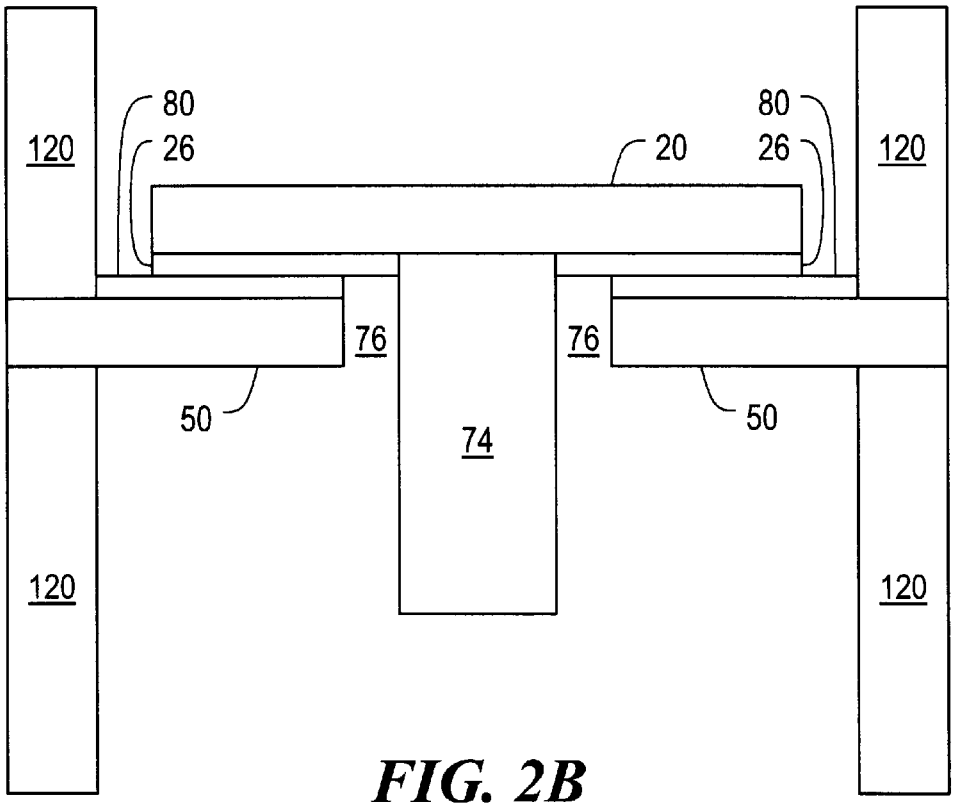
FIG. 2B is a cross sectional view of an insulating layer deposited on the shorting contact and electrostatic actuator shield according to an alternate embodiment of the present invention.

FIG. 2B shows a shorting contact insulating layer 26 disposed on shorting contact 20. A grounded electrostatic actuator shield insulating layer 80 can be disposed on grounded electrostatic actuator shield 50 facing the shorting contact 20. In this arrangement, the shorting contact 20 and grounded electrostatic actuator shield 50 are insulated from each other by the shorting contact insulating layer 26, and grounded electrostatic actuator shield insulating layer 80 when relay 100 is in the open position. Alternative structures could include either the grounded electrostatic actuator shield insulating layer 80 or shorting contact insulating layer 26 alone.

Figure 2C:
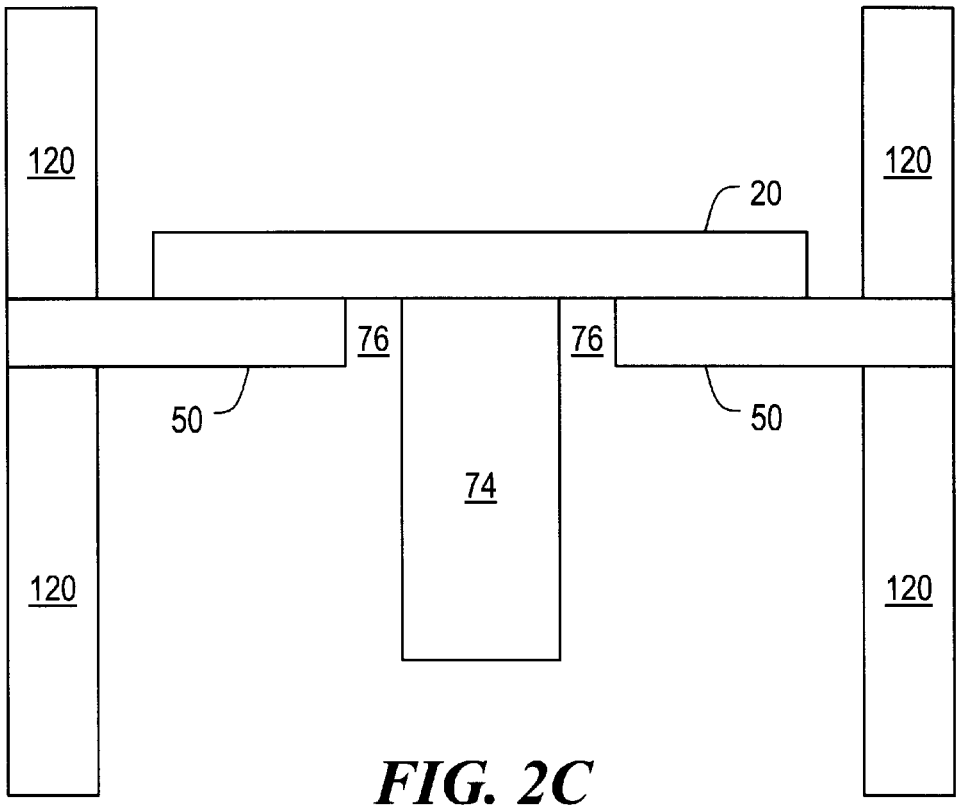
FIG. 2C is a cross sectional view of contacting metal surfaces between the shorting contact and the grounded electrostatic actuator shield according to the present invention.
Figure 2D:
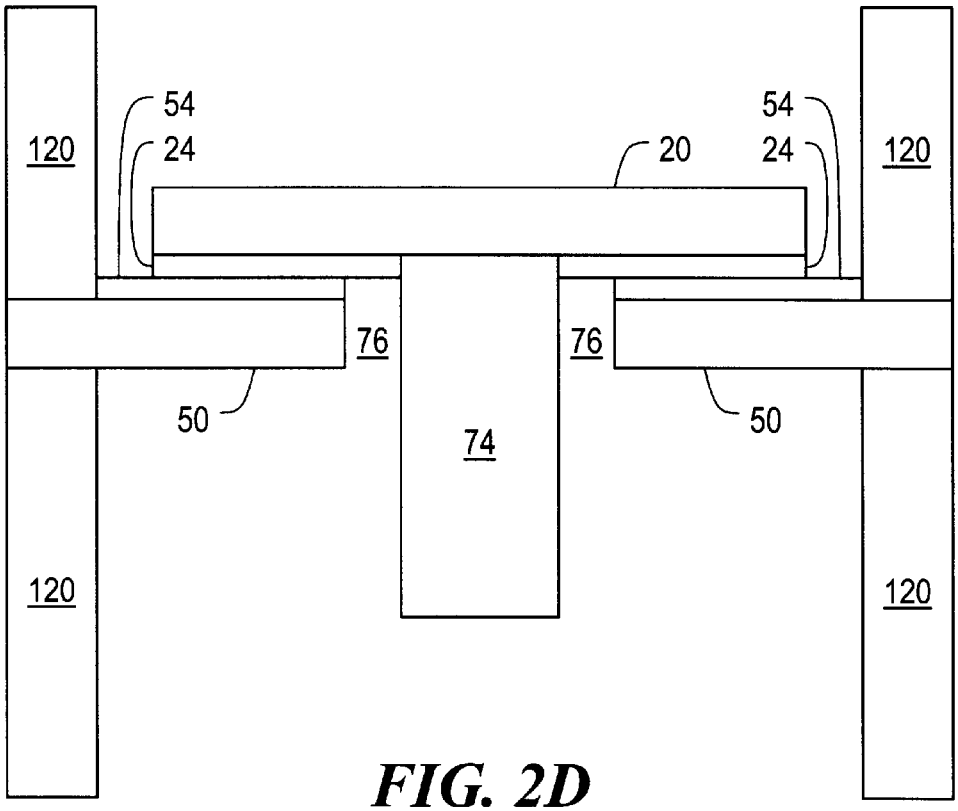
FIG. 2D is a cross sectional view of an additional metal layer deposited on the grounded electrostatic actuator shield and shorting contact according to an alternate embodiment of the present invention.

Referring now to FIGS. 2C and 2D a metal to metal (ohmic) contact is shown between the shorting contact 20 and the grounded electrostatic actuator shield 50 when relay 100 is in an open position. The shorting contact 20 and the grounded electrostatic actuator shield 50 can be solid metal or can include a metal coating. As with any contacting MEM structure, the contact surface may have several contact points representing a small portion of the available contact region, and the balance of the contact region will appear as a two plate capacitance across the ohmic contact regions.

Referring now to FIG. 2D, the metal surface of shorting contact 20 can connect the first set of shorting teeth 22 and the second set of shorting teeth 23 through the shorting contact metal layer 24 to the grounded electrostatic actuator shield metal layer 54 and the grounded electrostatic actuator shield 50 (and hence to electrical ground). Thus, the contact structures shown in FIGS. 2C and 2D apply an RF ground to the shorting contact 20 through the grounded electrostatic actuator shield 50 when relay 100 is in the open position.

As shown in FIG. 2D in an alternate embodiment, an additional grounded electrostatic actuator shield metal layer 54 is disposed on grounded electrostatic actuator shield 50 without the grounded electrostatic actuator shield insulating layer 80. The grounded electrostatic actuator shield metal layer 54 is an additional metalization on the grounded electrostatic actuator shield 50 with a material such as gold, nickel , copper, or rhodium having a different set of mechanical and electrical properties. The maximum shielding effectiveness of shield 50 will result when the grounded electrostatic actuator shield 50 is fabricated of metal or of metalized MEM fabrication material. A similar shorting contact metal layer 24 can be fabricated onto the shorting contact 20.

Electrical Relay Characteristics

Figure 3A:
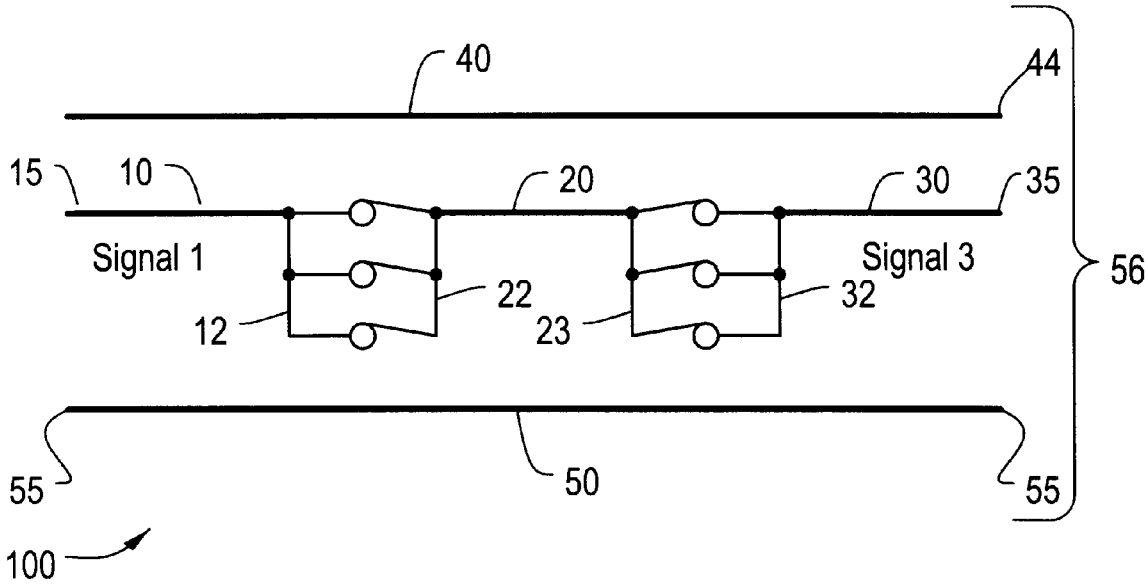
FIG. 3A is an equivalent circuit schematic of the inventive MEM relay in a closed position according to the present invention.
Figure 3B:
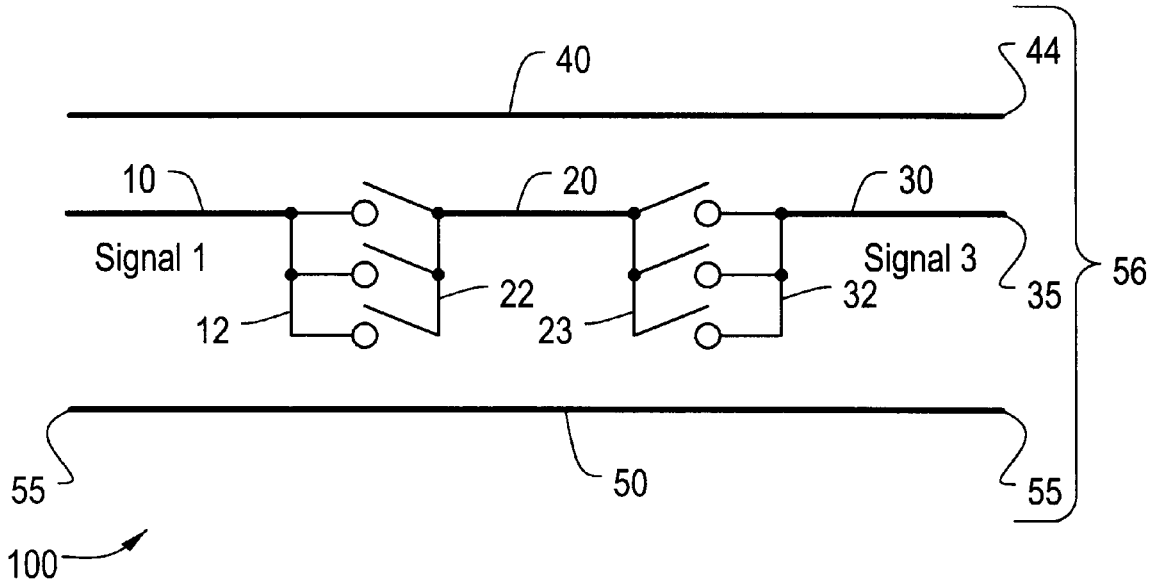
FIG. 3B is an equivalent circuit schematic of the inventive MEM relay in an open position according to the present invention.

Referring now to FIGS. 3A and 3B, in one embodiment, the relay 100 is represented in a schematic diagram of the RF relay 100 contact system. The relay 100 uses a multiple contact system including signal 1 contact 10, shorting contact 20, and signal 3 contact 30 (shown schematically with like reference numbers referring to the structures in FIGS. 1–2D). Preferably, the relay 100 is symmetric, and either the signal 1 contact 10 or the signal 3 contact 30 can be the input side physical terminal. When the relay 100 is closed as shown in FIG. 3A, both relay 100 contact sets are connected (signal 1 contact 10 to shorting contact 20, and shorting contact 20 to signal 3 contact 30. Corresponding to structures in FIGS. 1A, 3A and 3B schematically show signal 1 teeth 12 electrically connected to signal 1 contact 10, two sets of shorting teeth 22 and 23 connected to shorting contact 20, and signal 3 teeth 32 electrically connected to signal 3 contact 30. When the relay 100 is open as shown in FIG. 3B, both signal 1 contact 10 and signal 3 contact 30 and signal teeth 12 and 32 are disengaged from shorting teeth 22 and 23 and shorting contact 20. FIGS. 3A and 3B show the role of the shield structures 40 and 50 in forming a transmission line in association with the "center conductor" structures signal 1 contact 10, shorting contact 20, and signal 3 contact 30. Shield structures ground plane 40 and grounded electrostatic actuator shield 50 can be thought of as the outer conductor of the strip transmission line 56, although they are not fully enclosing the center conductor structures as described above. The physical construction of the strip transmission line 56 is similar to a conventional strip line assemble except that there is no homogeneous dielectric filling the space between the top and bottom grounds (the outer conductor) and the center conductor. Thus, the strip transmission line 56 is more complex than the typical structure used in conventional microwave engineering.

Figure 4A:
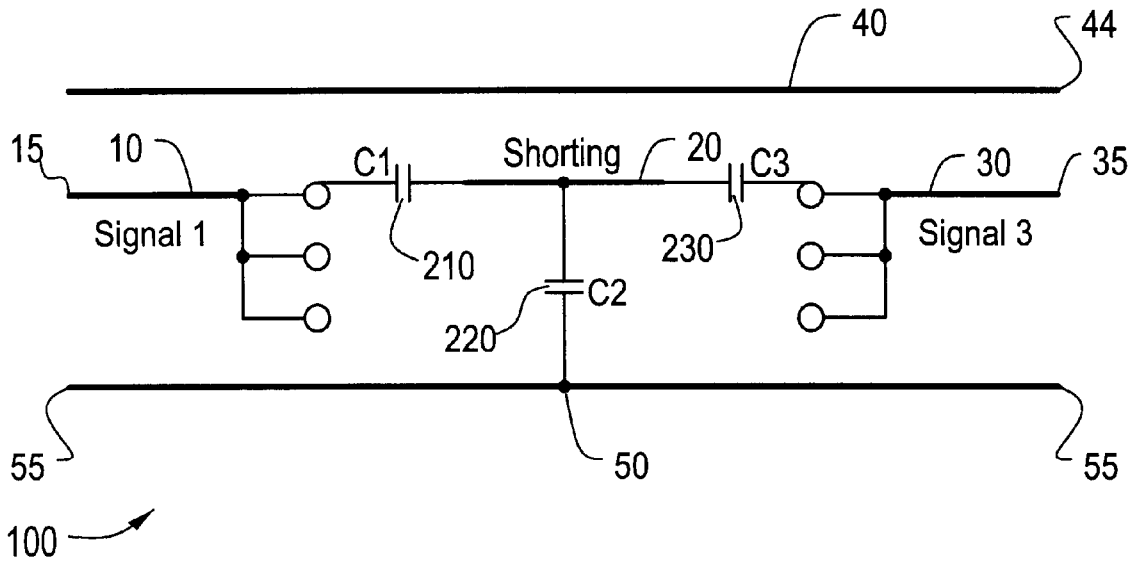
FIG. 4A is an equivalent circuit diagram of a MEM micro-relay in the open position according to the present invention.

FIG. 4A expands upon the schematic diagram of the open circuit relay 100, and indicates the attenuation mechanism for RF signals between the relay 100 external signal connection 15 and external signal connection 35. The coupling path from signal 1 contact 10 to signal 3 contact 30 with the relay 100 in the open position is represented by an equivalent capacitor C1 210 and an equivalent capacitor C3 230. The equivalent capacitor C1 210 is formed by the capacitive coupling between signal 1 contact 10 and shorting contact 20, and equivalent capacitor C3 230 is formed and capacitive coupling between shorting contact 20 and signal 3 contact 30. An equivalent capacitor C2 220 is formed by grounded electrostatic actuator shield separated from the shorting contact 20 surface by grounded electrostatic actuator shield insulating layer 80. The capacitance of the equivalent capacitor C1 210 is dependent on the separation between the signal contact structure 10 and shorting contact 20, and the capacitance of the equivalent capacitor C3 230 is dependent on the separation between the signal contact structure 30 and shorting contact 20. Further the effective surface area of the physical contact structures for signal teeth 12, both sets of shorting teeth 22 and 23, and signal teeth 32 will help determine this capacitance for capacitor C1 210 and capacitor C3 230. These two equivalent capacitors C1 210 and C3 230 are series arms of a capacitive "tee" attenuator. The center shunt capacitor C2 220 provides attenuation based on the ratio of capacitance in C1 210 and C3 230 to the capacitance of C2 220.

As shown electrically in FIG. 4A and mechanically in FIG. 2B, the capacitor C2 220 is formed by either grounded electrostatic actuator shield insulating layer 80, shorting contact insulating layer 26, or both placed between the grounded electrostatic actuator shield 50 and the shorting contact 20. This structure provides a significant capacitance from the shorting contact 20 to the grounded electrostatic actuator shield 50 represented as equivalent capacitor C2 220. A physical insulation layer could also be functionally provided by a defined gap 82 with the size determined by the actuator insulator 74 length (in the off position) and the structure of the relay 100 as shown in FIG. 2A. In FIG. 2A the physical spacing provides the insulator function as can also be accomplished by a specific fabrication material.

The depth of retraction of shorting teeth 22 from signal teeth 12 and shorting teeth 23 from signal teeth 32 is a relay 100 construction parameter as well as a design variable. The depth of retraction depends on the shape, flexure, and depth of the teeth as well as the motion travel available from the actuator. The actuator travel parameter is also related to the contact force the actuator 70 can provide to the closed relay 100 structure. Generally, metal contacts benefit from large contact forces, but large actuator travel may yield a reduced force capability. A greater separation between the signal teeth 12 and the shorting teeth 22 will yield a smaller coupling capacitance shown as C1 210 in FIG. 4A. Likewise, a greater separation between the signal teeth 32 and the shorting teeth 23 will yield a smaller coupling capacitance shown as C3 230. In some cases, it may only be necessary to disengage the teeth sufficiently to provide the desired open circuit (breakdown) voltage capability. The close proximity of shorting contact 20 structure and grounded electrostatic actuator shield 50 creates a significant shunt capacitance C2 220 and becomes part of a capacitive signal attenuator, as shown in FIG. 4A. Larger coupling capacitances (a large C1 210 or large C3 230) may be counteracted by larger shunt capacitance to ground 2 (C2 220).

Attenuation be increased by having a smaller coupling capacitance C1 210 and C3 230, and a larger capacitance C2

220. Increased attenuation with the relay 100 in the open position occurs with a wide spacing in the physical gap between the signal teeth 12 and the first set of shorting teeth 22 (to minimize capacitance), a wide spacing in the physical gap between the signal teeth 32 and the second set of shorting teeth 23, and a thin grounded electrostatic actuator shield insulating layer 80 between the shorting contact metal 20 and the grounded electrostatic actuator shield 50 (to maximize capacitance).

Figure 4B:
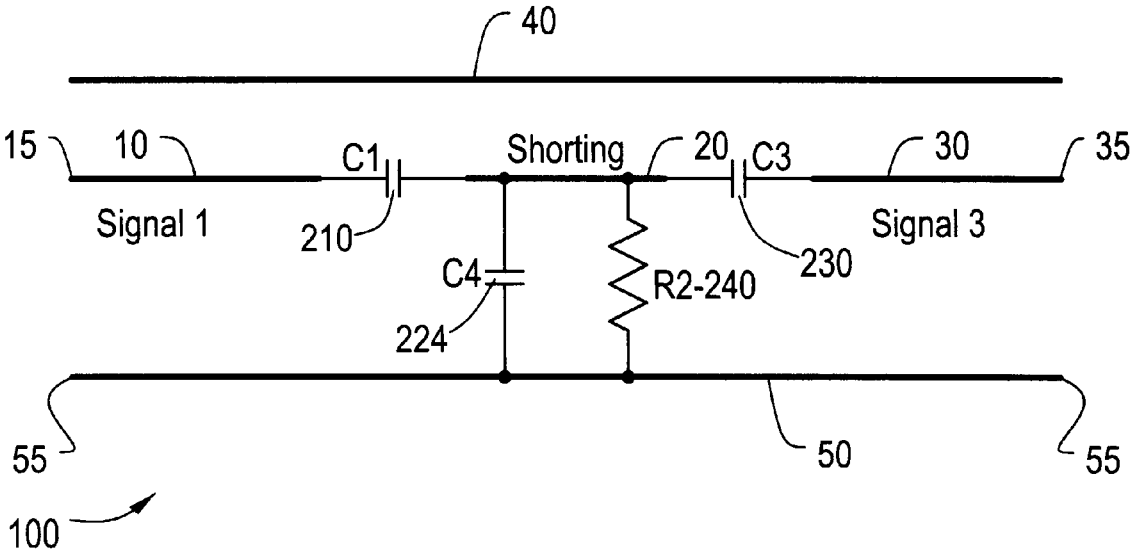
FIG. 4B is an equivalent circuit diagram of a MEM relay in the open position including an ohmic contact according to the present invention.

FIG. 4B shows a schematic representation for the attenuator function of the open circuit contact structure in an alternate embodiment. As shown electrically in FIG. 4B and mechanically in FIG. 2C, an equivalent capacitor C4 224 and resistor R2 240 are formed by the contact between grounded electrostatic actuator shield 50 and the shorting contact 20. For some contact configurations, a greater attenuation may be obtained by adding the shorting contact metal layer 24 to make physical (metal to metal ohmic) contact with the grounded electrostatic actuator shield metal layer 54 forming the equivalent resistor R2 240 as shown in FIG. 2D. This makes an additional metal-to-metal contact surface within the total relay 100 structure. The metal-to-metal contact of the shorting contact 20 with grounded electrostatic actuator shield 50 will create a low value shunt resistor R2 240 for the RF attenuator. The capacitance of shunt capacitor C4 224 is based upon the recognition that no MEM fabricated metal surface will have perfect uniform contact over the full surface. There will be some area of the shorting contact 20 interface with grounded electrostatic actuator shield 50 structure that will be in very close proximity (high capacitance) but lacking the metal-to-metal surface mating. Although a flat surface is shown in the FIGS. 2B and 2C, the shorting contact 20 interface with grounded electrostatic actuator shield 50 contact surface could assume any desired construction, including the meshed tooth construction of the signal path contacts. The choice of the capacitive or the resistive/capacitive shunt elements in the open circuit RF attenuator may be based on fabrication parameters, or it may be based on a calculation of the expected capacitances and resistances to yield the greatest possible signal attenuation over the widest possible frequency span. Larger coupling capacitances (a large capacitor C1 210 or C3 230) may be counteracted by the use of an ohmic contact yielding a very low value for resistor R2 240. With moderate to high attenuation values in the capacitive "tee" attenuator (C1 210, C4 224, C3 230) the current carrying requirements of resistor R2 240 are expected be relatively small compared to the current carrying requirements of the mating signal teethl2 and shorting teeth 22 or the mating shorting teeth 23 and signal teeth 32. The current in R2 240 will be primarily determined by the applied open circuit voltage at external signal connection 15 and external signal connection 35, the value of C1 210 and C3 230 and the operating frequency.

Multi-point Contacts

FIGS. 5A, 5B, 5C and 5D present several embodiments of relay 100 surface contact engagement and illustrate several typical contact engagement structures. Now referring to FIG. 5A, the various teeth signal 1 tooth 61, shorting tooth 62, and signal 3 tooth 63 (not shown) may engage at different times in the closure cycle, just as they may disengage at different times in the opening cycle. The availability of some degree of flexure in the tooth structure and in the signal 1 contact 10 and signal contact 30 structures will allow all the teeth 61, 62, 63 to engage when the relay 100 is fully closed. For maximum current carrying capability, it is undesirable to have some of the teeth not engaged when the relay 100 is closed, but that does not stop the relay 100 from functioning. In an alternate embodiment the life of the contact system can be extended by deliberately having some teeth (not shown) not engage until other teeth have worn significantly due to use and wear. This represents a design tradeoff between current carrying capability and long-term contact life.

Current carrying capability is maximized by having an exact mesh of all teeth in the contact structure. This is very difficult to achieve in practice, since it requires very precise alignment and fabrication of the tooth structure. Additionally, if the tooth surfaces were sufficiently smooth, it may be difficult to separate the teeth. This is particularly true if significant current is flowing in the metal-to-metal junction, as this would cause microscopic heating. The microscopic heating could cause an expansion of the metals and lock the teeth in place until the thermal expansion dissipated, or it could cause microscopic welding of the contact surfaces. Even if an exact mesh occurs, the metal surface is unlikely to be smooth to the point of providing a large number of microscopic contact points across the contact surface face.

Figure 5A:
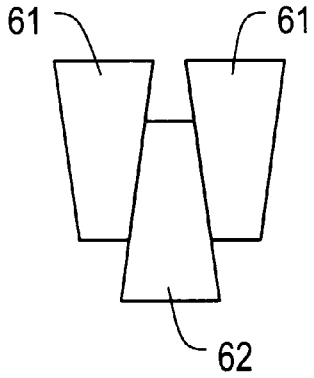
FIG. 5A is a cross sectional view of the meshing of the contact mating structures having convex surfaces in a closed position according to the present invention.
Figure 5B:
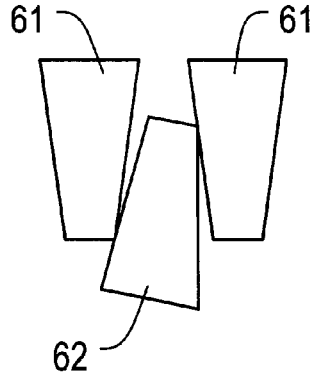
FIG. 5B is a cross sectional view of the meshing of the contact surface mating structures in a closed position with point contact on two surfaces according to the present invention.
Figure 5C:
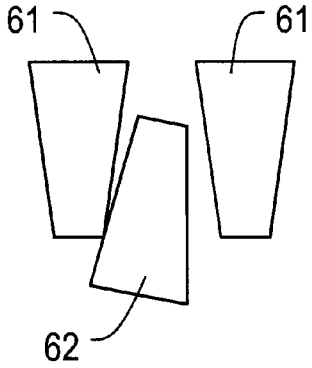
FIG. 5C is a cross sectional view of the meshing of the contact surface mating structures in a closed position with point contact on one surface according to the present invention.
Figure 5D:
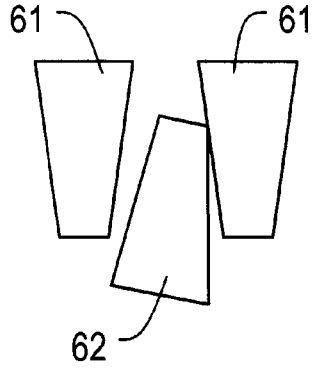
FIG. 5D is a cross sectional view of the meshing of the contact surface mating structures in a closed position with point contact on one surface according to the present invention.

Referring now to FIG. 5A, the meshing of both surfaces of shorting tooth 62 with signal teeth 61 is shown. Preferably signal 1 teeth 61 forming signal teeth 12, shorting teeth 62 forming shorting teeth 22 and 23, and signal 3 teeth 63 forming signal teeth 32 have convex surfaces to control thermal locking due to ohmic heating resulting from current flow. The use of a convex surface for both signal 1 teeth 61 and shorting teeth 62 and signal 3 teeth 63 and shorting teeth 62 promotes single point contacts and reduced capacitance (of the non-contact surfaces) between adjoining teeth. The degree of convex curvature is thus a specific design tradeoff between the potential metal to metal area in physical contact and the overall operation of the relay 100. Theoretically flat surfaces (if obtainable in practice).would be ideal providing the thermal issue is controlled. Concave surfaces for signal 1 teeth 61, shorting teeth 62 and signal 3 teeth 63 appear to be disadvantageous, although one convex and one concave mating surface are practical providing the radii of the two curvature does not promote locking. The actual contact surface shape is also a MEM fabrication issue. FIG. 5B shows point contacts on both surfaces of shorting tooth 62 and signal teeth 61. FIG. 5C shows a single point contact on one surface of shorting tooth 62 and signal teeth 61. FIG. 5D shows an alternate single point contact on one surface of shorting tooth 62 and signal teeth 61.

Preferably, the signal 1 teeth 61 and shorting teeth 62 and signal 3 teeth 63 teeth are solid structures having trapezoidal shapes and with about as much base width as there is tooth height, and etched to a thickness allowing self-alignment and formation of a multi-point contact system. Alternatively signal 1 teeth 61 and shorting teeth 62 and signal 3 teeth 63 could be triangular, hemispheric, or any other shape that promotes metal to metal surface mating. In a further alternative embodiment, signal 1 teeth 61 and signal 3 teeth 63 can be relatively larger than the shorting teeth 62 in order to remove heat while and shorting teeth 62 can be relatively thinner in order to maintain flexibility allowing self-alignment and formation of a multi-point contact system.

Alternatively structures that are able to flex or rotate somewhat in any dimension may also provide metal to metal mating. Flexure may also provide some compensation for the tooth structure fabrication restrictions of MEM processes used to manufacture the relay 100.

The heating problem in metal to metal (ohmic) contacts is a well known problem. The avoidance of significant temperature rise is a benefit to the contact system, and requires that at least one of the contact structures signal teeth 12 and signal teeth 32 or shorting teeth 22 and shorting teeth 23 be designed to promote heat flow away from the mating surface points. Alternately, the entrapment of heat in the contact region could result in the melting of the contact metals. This could result in a highly desirable liquid metal contact system. Current practice in the conventional (non-MEM) relay industry rejects such an operating mode as unacceptable.

Figure 6:
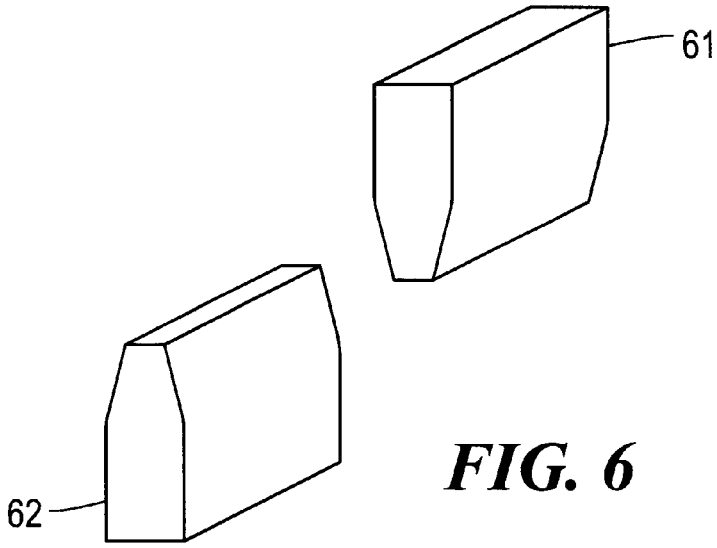
FIG. 6 is a perspective view of the convex surface in a perspective view of the flexible electrically conductive signal teeth according to the present invention.

FIG. 6 shows signal 1 tooth 61 and shorting tooth 62 fabricated with convex surfaces which result in a better meshing configuration. The DRIE (bulk) process can fabricate three dimensional contact structures while surface micromachining is limited to creating flat contact surface structures. Two convex surfaces are assured of a well defined two contact point engagement, and local heating effects causing metal expansion will just tend to push the contacts apart rather than locking them in engagement.

Alternatively the teeth could have a ball and socket construction (not shown) in order to avoid becoming mechanically locked by conductive head. In this embodiment, one tooth would have a convex surface which would mesh with a concave surface on the corresponding tooth.

There are many physical structure variations to the contact geometry that remain within the concepts put forth in this disclosure. The portions of the metal surfaces that are not in direct metal-to-metal contact will exhibit a capacitance effectively in shunt with the ohmic resistance of the metal to metal contacts. At very high frequencies and with a large surface area, this could become a significant current carrying enhancement to the metal to metal contact.

Due to the current state of the art limitations in fabricating MEM relays, it is possible that there will be some minor misalignment of the teeth 61, 62, 63 in the different metal structures, and they will exhibit point contacts on two surfaces. This is actually a more exaggerated version of the point contact conditions discussed above for the "exact mesh" contact engagement. If the teeth 61, 62, 63 are not well aligned, there may be contact only on one face of each tooth, as shown in FIG. 5C or FIG. 5D. A single contact point per tooth is less desirable since it reduces the current carrying capacity of each tooth-to-tooth mating surface, but it is not a primary limitation on the performance of the relay 100.

In an alternate embodiment, portions of signal 1 contact 10 and the signal 3 contact 30 contact can be suspended in the signal contact region 45. This will result from a complete removal of the substrate material underneath the signal contact structures 10 and 30. The signal contact structures 10 and 30 will still require support, and it may be obtained through the insulators 120 and the housing 1 10. This embodiment may allow some increased flexibility for aligning the signal 1 contact 10 and signal 3 contact 30 structures with the shorting contact 20 when the relay 100 is closed. The suspended sections, signal 1 contact 10, shorting contact 20, and signal 3 contact 30, may have a different shape than the shape shown in FIG. 1A to adjust the control the RF impedance of the signal path when the relay 100 is closed. The MEM fabrication process determines the method of mounting used for the signal 1contact 10 and signal 3 contact 30 structures.

In an alternate contact configuration the self-aligning properties of the contact structure may be enhanced by having a flexible set of contact surfaces or a single flexible contact surface. The electrically conductive structures signal 1 contact 10, shorting contact 20, and signal 3 contact 30 and teeth 61, 62, and 63 may include solid metal structures, hollow metal structures, a solid MEM fabrication material (semiconductor or insulator) covered with an electrically conductive surface, or a hollow MEM fabrication material covered with an electrically conductive surface. If the free ends of the hollow structures are omitted, the structures will potentially be more flexible. Flexibility of the conductive signal surfaces promotes maximum surface contact between mating structures.

Gas Fill

Referring again to FIG. 1A, there is no restriction on the gas used to fill the signal contact region 45 and the actuator region 75, other than the need for an insulating gas to prevent electrical breakdown at higher voltages. This includes dry air (humidity is known to cause problems on the micro-scale), dry inert gas, or a special gas such as sulfur hexafluoride (SF6). The use of SF6 may provide additional voltage capability to micro-scale contacts as well as reducing the arcing during hot switching actions (opening the relay 100 while current is flowing), just as it is known to do for macro-scale contacts.

Metallurgy Requirements

There is no specific restriction on the metals used in the production of this contact system, although good electronic and thermal conductors are generally more desirable than poor conductors. The primary source of metal restriction will be due to the MEM fabrication process in use, and the tolerance of the fabrication facility toward various metals. There has been virtually no research to date on the issue of hot switching in micro-scale contacts, and the role of the contact metals selected and ambient gas surrounding the contacts. Generally, the contact metals in use with present technology non-MEM relays are not favored in the MEM fabrication process, and the research on hot switching in present non-MEM relay contacts may not be applicable to a MEM fabricated relay. The speed of separation of the contacts in relationship to the time required to ionize the ambient gas (or establish an electron flow in a vacuum) may prove to be a factor in hot switching performance. High-speed contact separation may prove to be a significant issue in the lifetime of hot switched metal contacts. The use of a high speed, high retraction force actuator will minimize the contact separation time interval.

High Power Alternative Metallurgy

In an alternate embodiment, this inventive relay 100 is manufactured from high temperature superconducting (HTS) metal formulations. Relay 100 has a very small volume and mass, and can be easily cooled. While HTS materials will require that the MEM micro-relays be cooled to the appropriate temperature, a very small solid state cooler (not shown) may be very acceptable. When HTS metal formulations are used, there will be no ohmic loss in any metal-to-metal contact, and the current carrying capacity of the relay 100 will be limited by magnetic field effects in the superconductor causing a transition out of the superconducting state. The use of HTS materials for the contacts will provide an exceptionally high power microrelay.

Integrated Construction

If the metal structures for signal 1 contact 10 and signal 3 contact 30 are extended to the dicing lines (the "streets") then the dicing process will expose external signal connection 15, external signal connection 35, external ground plane connections 44, external grounded electrostatic actuator shield connections 55 and the actuator control contacts 78 and 79. Exposing the metal conductors needed to create the fully functional relay 100 eliminates the need for a separate and additional packaging structure and bond wires. The creation of a fully assembled and sealed relay 100 before wafer dicing by the bonding of a top (and bottom) cover to the DRIE wafer also eliminates the problem of contamination of the relay 100 due to the wafer dicing debris. The elimination of the bond wires from the die to an external package also eliminates a major source of coupling between the signal input and the signal output with the relay 100 open, and it eliminates the RF impedance disruption caused by the bond wires when the relay 100 is closed. The elimination of bond wires is highly desirable but is not required. As is known in the art, other processes to form external contacts on a self-packaging MEM structure will accomplish the same goal and are also appropriate. An alternate means of fabrication includes the use of sacrificial material through the dicing line region, and the subsequent etching and filling with metal after dicing. Alternatively external vias (not shown) and bond/solder pads 128 can directly connect the relay 100 with other electronic circuitry.

There is no size limit suggested for the MEM relay 100, and it can be as small (limited by fabrication and current carrying capacity) or as large (to obtain high current carrying capacity) as permitted by fabrication technology and user requirements. The structure of existing surface microrelays is often in the hundreds of micrometers square. Open circuit voltage capabilities of existing MEM relays currently range from tens of volts to hundreds of volts. Closed circuit current capabilities range from microamperes to amperes. Metal contact resistances range from ohms to fractions of an ohm. Contact lifetimes depend on the definition of an unacceptable contact and the mode of contact testing, and range from tens of open-close cycles to millions or billions of open-close cycles.

Those skilled in the art will also recognize that the teachings of the present invention may be realized in additional structural designs that allow one to create a different configuration of signal contacts including a plurality of relay 100 contacts. different shapes of teeth, varying ohmic heat flows, various RF impedance properties, various actuator techniques, and various packaging methods for the fully fabricated relay 100.

Although the inventive teachings are disclosed with respect to RF applications, the present teachings may be used for a wider range of frequencies and other applications as will be appreciated by those skilled in the art.

One skilled in the art will appreciate further features and advantages of the invention based on the above-described embodiments. Variations and modifications may be made to the invention, with attainment of some or all of the advantages of the invention. Therefore, it is the object of the appended claims to cover all such variations and modifications as come within the spirit and scope of the present invention.

What is claimed is:

1. A MEM relay comprising:

a housing;

a first signal contact disposed on said housing;

a second signal contact disposed on said housing;

a grounded electrostatic actuator shield disposed on said housing forming a signal contact region and an actuator region and an aperture connecting said signal contact region and said actuator region;

an actuator, selectively movable between an open and closed position, disposed on said housing;

an actuator insulator disposed on said actuator and passing through said aperture; and a movable shorting contact disposed on said actuator insulator in a spaced apart relation with said first signal contact and said second signal contact.

2. The MEM relay as recited in claim 1 wherein said grounded electrostatic actuator shield is placed in electrical communication with said shorting contact when said actuator is in the open position.

3. The MEM relay as recited in claim 1 further comprising:

an insulator disposed on a surface of said grounded electrostatic actuator shield facing said shorting contact.

4. The MEM relay as recited in claim 1 further comprising:

an insulator disposed on a surface of said shorting contact facing said grounded electrostatic actuator shield.

5. The MEM relay as recited in claim 1 further comprising:

an insulator disposed on a surface of said grounded electrostatic actuator shield facing said shorting contact; and an insulator disposed on a surface of said shorting contact facing said grounded electrostatic actuator shield.

6. The MEM relay as recited in claim 1 wherein said grounded electrostatic actuator shield is insulated from said shorting contact by maintaining a physical separation between said grounded electrostatic actuator shield and said shorting contact when said actuator is in the open position.

7. The MEM relay as recited in claim 1, wherein said signal contact region and said actuator region are filled with an insulating gas.

8. The MEM relay as recited in claim 7, wherein said insulating gas is a dry inert gas.

9. The MEM relay as recited in claim 8, wherein said dry inert gas is sulfur hexafluride.

10. The MEM relay as recited in claim 1 further comprising:

a metal layer disposed on a surface of said grounded electrostatic actuator shield facing said shorting contact and in electrical contact with said grounded electrostatic actuator shield.

11. The MEM relay as recited in claim 1 further comprising:

a metal layer disposed on a surface of said shorting contact facing said grounded electrostatic actuator shield and in electrical contact with said shorting contact.

12. The MEM relay as recited in claim 1 further comprising:

a ground plane disposed on said housing in a spaced apart relation with said first signal contact and second signal contact whereby said first signal contact and second signal contact are located between said ground plane and said movable shorting contact; and a grounded electrostatic signal shield disposed between said first signal contact and said second signal contact in electrical communication with said ground plane.

13. The MEM relay as recited in claim 1 wherein said ground plane is in electrical communication with said grounded electrostatic actuator shield.

14. The MEM relay as recited in claim 2 further comprising:

a metal layer disposed on said grounded electrostatic actuator shield.

15. The MEM relay as recited in claim 2 further comprising:

a metal layer disposed on said shorting contact.

16. A MEM relay comprising:

a housing;

a first signal contact disposed on said housing;

a second signal contact disposed on said housing;

an actuator, selectively movable between an open and closed position;

an actuator insulator disposed on said actuator;

a movable shorting contact disposed on said actuator insulator in a spaced apart relation with said first signal contact and said second signal contact; and a ground plane disposed on said housing in a spaced apart relation with said first signal contact and second signal contact wherein said first signal contact and second signal contact are located between said ground plane and said movable shorting contact.

17. The MEM relay as recited in claim 16 further comprising:

a grounded electrostatic signal shield, in electrical communication with said ground plane, disposed between said first signal contact and said second signal contact.

18. The MEM relay as recited in claim 17 further comprising:

an insulator disposed on a surface of said grounded electrostatic actuator shield facing said shorting contact; and an insulator disposed on a surface of said shorting contact facing said grounded electrostatic actuator shield.

19. The MEM relay as recited in claim 16 further comprising:

a ground plane disposed on said housing in a spaced apart relation with said first signal contact and second signal contact whereby said first signal contact and second signal contact are located between said ground plane and said movable shorting contact; and a grounded electrostatic signal shield disposed between said first signal contact and said second signal contact in electrical communication with said ground plane.

20. A MEM relay comprising:

a first signal contact;

a first set of electrically conductive signal teeth in electrical communication with said first signal contact;

a second signal contact;

a second set of electrically conductive signal teeth in electrical communication with said second signal contact;

an actuator, selectively movable between an open and closed position, disposed on said housing;

an actuator insulator disposed on said actuator;

a movable shorting contact disposed on said actuator insulator in a spaced apart relation with said first signal contact and said second signal contact; and at least two sets of electrically conductive shorting teeth disposed on said shorting contact such that said at least two sets of electrically conductive shorting teeth can be mechanically meshed placing said shorting contact in electrical communication with said first set of electrically conductive signal teeth and said second set of electrically conductive signal teeth, when said actuator is in the closed position.

21. The MEM relay as recited in claim 20 further comprising:

a grounded electrostatic actuator shield forming a signal contact region and an actuator region and an aperture connecting said signal contact region and said actuator region.

22. The MEM relay as recited in claim 21 wherein said grounded electrostatic actuator shield is placed in electrical communication with said shorting contact when said actuator is in the open position.

23. The MEM relay as recited in claim 21 further comprising:

an insulator disposed on a surface of said grounded electrostatic actuator shield facing said shorting contact.

24. The MEM relay as recited in claim 21 further comprising:

an insulator disposed on a surface of said shorting contact facing said grounded electrostatic actuator shield.

25. The MEM relay as recited in claim 21 wherein said grounded electrostatic actuator shield is insulated from said shorting contact by maintaining a physical separation between said grounded electrostatic actuator shield and said shorting contact when said actuator is in the open position.

26. The MEM relay as recited in claim 20 further comprising:

a grounded electrostatic shield disposed between said first signal contact and second signal contact.

27. The MEM relay as recited in claim 20 further comprising:

a ground plane disposed in a spaced apart relation with said first signal contact and said second signal contact.

28. The MEM relay as recited in claim 20 further comprising:

a ground plane disposed on said housing in a spaced apart relation with said first signal contact and second signal contact whereby said first signal contact and second signal contact are located between said ground plane and said movable shorting contact; and a grounded electrostatic signal shield disposed between said first signal contact and second signal contact in electrical communication with said ground plane.

29. The MEM relay as recited in claim 20, wherein the electrically conductive shorting teeth are metal.

30. The MEM relay as recited in claim 20, wherein the electrically conductive shorting teeth have a trapezoidal shape.

31. The MEM relay as recited in claim 20, wherein said first set of electrically conductive signal teeth, said second set of electrically conductive signal teeth, and electrically conductive shorting teeth have convex surfaces.

32. The MEM relay as recited in claim 21, wherein said signal contact region and said actuator region are filled with an insulating gas.

33. The MEM relay as recited in claim 32, wherein said insulating gas is a dry inert gas.

34. The MEM relay as recited in claim 33, wherein said dry inert gas is sulfur hexafluride.

35. The MEM relay as recited in claim 20, wherein said first signal contact and said second signal contact are made from high temperature superconducting (HTS) metal formulations for increased current capacity.

36. The MEM relay as recited in claim 20, further comprising a solid state cooler in thermal communication with said first signal contact, said second signal contact and said actuator.

37. The MEM relay as recited in claim 20, wherein said first set of electrically conductive signal teeth, second set of electrically conductive signal teeth, and signal teeth and said at least two sets of electrically conductive shorting teeth are etched to a thickness allowing self-alignment and formation of a multi-point contact system.

38. The MEM relay as recited in claim 20, wherein the electrically conductive shorting teeth have non symmetric shapes and will not simultaneously engage with all opposing teeth until other teeth have worn significantly due to use and wear such that the life of the contact system can be extended.

39. The MEM relay as recited in claim 20, wherein said first set of electrically conductive signal teeth, said second set of electrically conductive signal teeth, and electrically conductive shorting teeth have matching concave to convex surfaces.

* * * * *

UNITED STATES PATENT AND TRADEMARK OFFICE

CERTIFICATE OF CORRECTION

PATENT NO. : 6,587,021 B1
DATED : July 1, 2003
INVENTOR(S) : Richard D. Streeter It is certified that error appears in the above-identified patent and that said Letters Patent is hereby corrected as shown below:

Column 1,
Line 27, delete “Additionally in” and replace with -- Additionally, in --.

Column 3,
Line 6, delete “arrangement the” and replace with -- arrangement, the --.

Column 4,
Line 59, delete “slice though the” and replace with -- slice through the --.

Column 7,
Line 44, delete “provided. here.” and replace with -- provided here. --.

Column 8,
Line 43, delete “teeth 22 shorting” and replace with -- teeth 22 and shorting --.

Column 9,
Line 1, delete “2D a metal” and replace with 2D, a metal --.
Line 45, delete “contact 30.” and replace with -- 2D, a metal --.

Column 10,
Line 19, delete “Further the” and replace with -- Further, the --.
Line 39, delete “In FIG. 2A” and replace with -- In FIG. 2A, --
Line 66, delete “Attenuation be” and replace with -- Attenuation can be --.

Column 11,
Line 47, delete “expected be” and replace with -- expected to be --.
Line 49, delete “teeth 12” and replace with -- teeth 12 --.
Line 64, delete “signal contract 30” and replace with -- signal 3 cotnact 30 --.

Column 12,
Line 2, delete “embodiment the” and replace with -- embodiment, the --.
Line 58, delete “remove heat while and” and replace with -- remove heat while the --.

UNITED STATES PATENT AND TRADEMARK OFFICE

CERTIFICATE OF CORRECTION

PATENT NO. : 6,587,021 B1
DATED : July 1, 2003
INVENTOR(S) : Richard D. Streeter It is certified that error appears in the above-identified patent and that said Letters Patent is hereby corrected as shown below:

Column 13,
Lines 31 and 33, delete “metal to metal” and replace with -- metal-to-metal --.
Line 53, delete “1 10.” and replace with -- 110. --
Line 59, delete “adjust the contro”and replace with -- adjust and control --.
Line 62, delete “signal 1contact” and replace with -- configuration, the --.
Line 64, delete “configuration the” and replace with -- configuration, the --.

Column 19,
Line 8, delete “non symmetric” and replace with -- non-symmetric --.

Signed and Sealed this

Fifth Day of April, 2005

JON W. DUDAS
*Director of the United States Patent and Trademark Office*

UNITED STATES PATENT AND TRADEMARK OFFICE

CERTIFICATE OF CORRECTION

PATENT NO. : 6,587,021 B1
DATED : July 1, 2003
INVENTOR(S) : Richard D. Streeter It is certified that error appears in the above-identified patent and that said Letters Patent is hereby corrected as shown below:

Title page,
Item [75], Inventor, delete "Richard D. Streeter" and replace with -- Robert D. Streeter --.

Signed and Sealed this

Twenty-eighth Day of June, 2005

JON W. DUDAS
*Director of the United States Patent and Trademark Office*